US012543810B1

(12) United States Patent
Fang

(10) Patent No.: US 12,543,810 B1
(45) Date of Patent: Feb. 10, 2026

(54) PRESSING MACHINE FOR ASSEMBLING CRAFT FLOWERS

(71) Applicant: Weitao Fang, Puning (CN)

(72) Inventor: Weitao Fang, Puning (CN)

( * ) Notice: Subject to any disclaimer, the term of this patent is extended or adjusted under 35 U.S.C. 154(b) by 0 days.

(21) Appl. No.: 19/218,564

(22) Filed: May 26, 2025

(30) Foreign Application Priority Data

Apr. 24, 2025 (CN) ..... 202520796967.9

(51) Int. Cl.
*A41G 1/02* (2006.01)

(52) U.S. Cl.
CPC ..... *A41G 1/02* (2013.01)

(58) Field of Classification Search
None
See application file for complete search history.

(56) References Cited

U.S. PATENT DOCUMENTS 2,666,249 A * 1/1954 Ruiz ..... A41G 1/00 28/150
3,309,001 A * 3/1967 Thayer ..... A41G 1/02 223/46
4,192,580 A * 3/1980 Meyer ..... G02B 21/0008 359/801
5,407,108 A * 4/1995 Hambright ..... D04D 7/10 223/46
D401,976 S * 12/1998 Wong ..... D21/483
D401,977 S * 12/1998 Wong ..... D21/483
D460,128 S * 7/2002 Rosen ..... D21/483
9,730,480 B2 * 8/2017 Kim ..... A41G 1/02
9,986,776 B2 * 6/2018 Kim ..... A41G 1/02
D1,080,752 S * 6/2025 Zheng ..... D21/483
2023/0322014 A1 * 10/2023 Bassett ..... A41G 1/02 144/349

FOREIGN PATENT DOCUMENTS

EP 1095575 B1 * 11/2002 ..... A47G 33/06

OTHER PUBLICATIONS

Toyly Fabric Flower Bouquets Toys, Date First Available Mar. 15, 2024 [online], [site visited Oct. 20, 2025]. Available from Internet: <URL: https://www.amazon.com/Fabric-Flower-Bouquets-Toys-Craft/dp/B0CY5BQPR8?th=1 (Year: 2024) (Year: 2024).*

* cited by examiner

*Primary Examiner* — Michael N Orlando
*Assistant Examiner* — Abhishek A Patwardhan

(57) ABSTRACT

A pressing machine for assembling craft flowers is provided, including a positioning housing and a rotating arm rotatably mounted on the positioning housing; the rotating arm is equipped with a positioning sleeve and a pressing member slidably mounted in the positioning sleeve, the positioning sleeve has a first guide hole, the pressing member has a first pressing rod, and the first pressing rod slides relative to the first guide hole; the positioning housing is provided with a positioning hole for positioning the craft flower, and the positioning hole matches the positioning sleeve. The pressing machine saves effort when assembling craft flowers and ensures that they are fully assembled in place, thereby improving assembly efficiency.

9 Claims, 8 Drawing Sheets

PRESSING MACHINE FOR ASSEMBLING CRAFT FLOWERS

RELATED APPLICATIONS

The present application claims the benefit of priority of Chinese Patent Application No. 202520796967.9, filed Apr. 24, 2025, and entitled "PRESSING MACHINE FOR ASSEMBLING CRAFT FLOWERS," the entire content of which is incorporated herein by reference.

TECHNICAL FIELD

The present application relates to the technical field of auxiliary equipment for assembling craft flowers, and in particular to a pressing machine for assembling craft flowers.

BACKGROUND

Craft flowers generally include independently injection-molded parts such as leaves, petals and stamens. Stamens are plugged into petals and leaves in sequence to achieve overall molding and keep the state fixed. The connection by plugging requires a certain interference and pressure to achieve compression. Although manual operation can realize the assembly of craft flowers, it is easy to cause hand fatigue. Moreover, the manual assembly method is difficult to ensure that the craft flowers are fully assembled in place.

SUMMARY

(I) Technical Problem

The purpose of the present application is to provide a pressing machine for assembling craft flowers, resulting in labor saving and ensuring complete assembly in place.

(II) Technical Solution

In order to achieve the above purpose, the present application provides the following technical solution:

A pressing machine for assembling craft flowers, including a positioning housing and a rotating arm rotatably mounted on the positioning housing; the rotating arm is equipped with a positioning sleeve and a pressing member slidably mounted in the positioning sleeve, the positioning sleeve has a first guide hole, the pressing member has a first pressing rod, and the first pressing rod slides relative to the first guide hole; the positioning housing is provided with a positioning hole for positioning the craft flower, and the positioning hole matches the positioning sleeve.

Preferably, the positioning sleeve includes a second guide hole connected to and coaxial with the first guide hole, the positioning sleeve is provided with a first positioning portion located at an opening of the second guide hole, and the first positioning portion is provided with a first limiting groove.

Preferably, the pressing member includes a sliding sleeve slidably mounted in the second guide hole, a pressing handle is mounted on the sliding sleeve, a locking column is arranged in the sliding sleeve, a locking portion configured to fit with the locking column is arranged in the pressing handle, and a fastener passes through the locking portion and is fastened to the locking column.

Preferably, the pressing handle includes a handle housing mounted on the sliding sleeve and a handle cover detachably connected to the handle housing, and the locking portion is integrated at the bottom of the handle housing.

Preferably, the top of the handle housing and the handle housing are enclosed to form a flower-shaped structure.

Preferably, a rotating end of the rotating arm is provided with a rotating portion extending to both sides, a rotating groove is opened on the positioning housing, and two ends of the rotating portion are rotatably connected to two side walls of the rotating groove, respectively.

Preferably, the rotating arm is provided with a mounting groove for mounting the first positioning portion, at least two limiting protrusions extending outward are provided on an outer side of the first positioning portion, and the mounting groove is provided with a rotation stop groove plug-fitted to the limiting protrusion; the rotating arm is provided with a sliding hole that is slidably engaged with the handle housing, and a diameter of the opening end portion of the sliding sleeve is larger than an aperture of the sliding hole.

Preferably, the rotating arm includes a first arm housing and a second arm housing that are detachably connected.

Preferably, the positioning housing includes a bottom housing and a top housing that are screw-fitted, the positioning hole is arranged in the middle of the top housing, an upwardly protruding positioning platform is arranged in the bottom housing, and the positioning platform is coaxial with the positioning hole; the rotating groove is arranged on the top housing.

Preferably, the top housing is provided with a conical surface inclined toward the positioning hole, and the conical surface is provided with a flower-patterned surface.

Preferably, a cross section of the positioning housing is a flower-shaped structure.

Preferably, a positioning step is provided at an opening of the bottom housing, multiple grooves and multiple limiting bayonets evenly distributed along a circumference are provided on a side wall of the positioning step, and the groove and the limiting bayonet are one-to-one connected correspondingly; an opening of the top housing is provided with a limiting edge extending into the positioning step, and a side wall of the limiting edge is provided with snap-fit bosses evenly distributed along a circumference and engaged with the limiting bayonet; when the top housing is rotated and locked relative to the bottom housing, the snap-fit boss rotates from the groove to the limiting bayonet.

Preferably, an end portion of the positioning sleeve is provided with a second positioning portion extending downward, the first guide hole passes through the second positioning portion, and a positioning notch is provided at an opening of the second positioning portion.

(III) Beneficial Effects

Craft flowers are assembled or disassembled by a pressing machine, which reduces hand fatigue caused by manual assembly or disassembly, and can ensure that the craft flower can be fully assembled in place. The flower and leaf portion of the craft flower is positioned by setting a positioning hole on the positioning housing. After the petal portion and the stamen portion of the craft flower are initially inserted into the flower and leaf portion, the positioning sleeve is rotated to form a preliminary compression position by rotating the rotating arm, and the pressing member is pushed downward. On the one hand, pressure is continued to be applied through the positioning sleeve to press the leaf portion by plugging, and at the same time, the first pressing rod is allowed to pass through the first guide hole to further press the stamen portion by plugging, thereby realizing the assembly of the entire craft flower;

in addition, the first pressing rod can be used to press the stamen portion when disassembly is required, so that the disassembly operation can be performed with relatively less effort; and in this way, the three components of the craft flower can be pressed and assembled simultaneously by operating the pressing machine, thereby improving assembly efficiency and ensuring assembly stability.

BRIEF DESCRIPTION OF THE DRAWINGS

In FIG. 1 to FIG. 10, the relationship between the component names or lines and numerical references is as follows:

Figure 1:
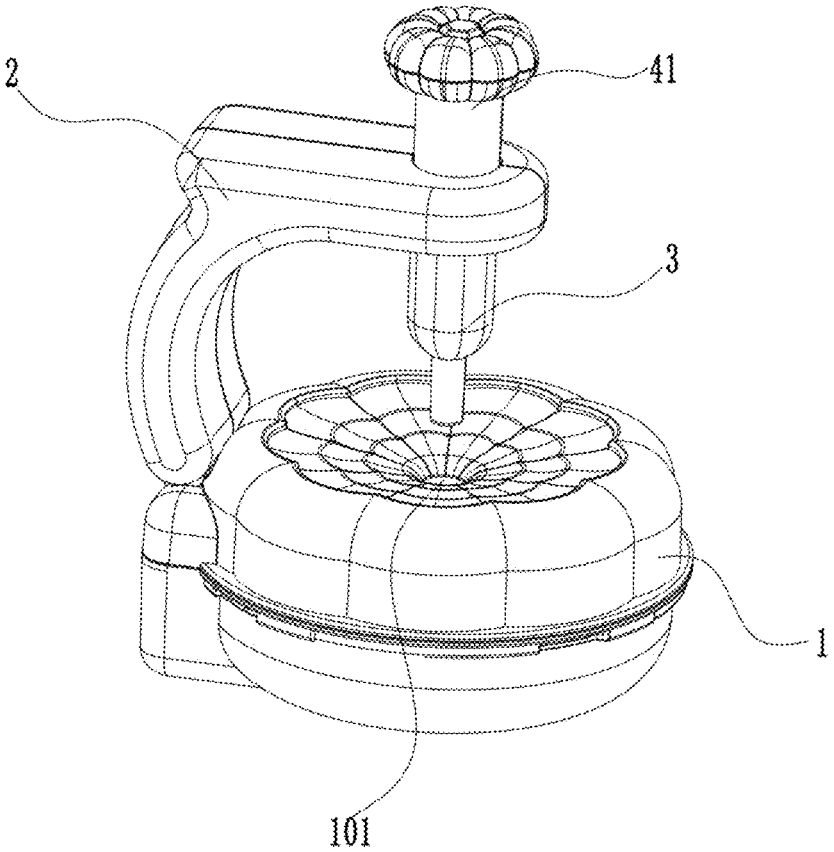
FIG. 1 is a schematic diagram of a three-dimensional structure according to an embodiment of the present application.

positioning housing 1, positioning hole 101, rotating groove 102, bottom housing 103, top housing 104, positioning platform 105, conical surface 106, positioning step 107, groove 108, limiting bayonet 109, limiting edge 1010, snap-fit boss 1011, rotating arm 2, rotating portion 21, mounting groove 22, rotation stop groove 23, sliding hole 24, first arm housing 25, second arm housing 26, positioning sleeve 3, first guide hole 31, second guide hole 32, first positioning portion 33, first limiting groove 34, limiting protrusion 35, second positioning portion 36, positioning notch 37, pressing member 4, first pressing rod 41, sliding sleeve 42, pressing handle 43, handle housing 431, handle cover 432, locking column 44, locking portion 45.

DETAILED DESCRIPTION

The technical solutions in the embodiments of the present application will be clearly and completely described below with reference to the figures in the embodiments. Obviously, the embodiments described are only a part of the embodiments of the present application.

In an embodiment of the present application, a pressing machine for assembling craft flowers is proposed. As a kind of handicraft, a craft flower generally includes leaf portion, petal portion and stamen portion. They are assembled by sequential interference plugging, and the stamen portion can be relatively inserted into the petal portion. The craft flower requires a large force when assembling. Simple manual pressing can easily cause hand fatigue and damage to hands. In addition, other tools are required for disassembly, and even so the disassembly is difficult. In order to solve the current problems, it is necessary to design a pressing machine that adapts to the composition structure of the craft flower to ensure that the craft flower is fully assembled in place and reduce hand fatigue. Moreover, it can provide disassembly operations.

Figure 2:
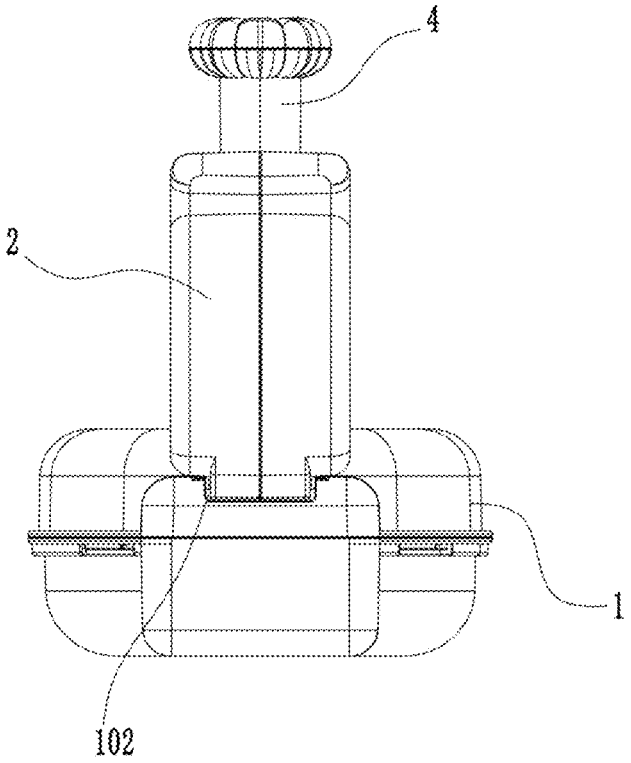
FIG. 2 is a schematic diagram of a structure according to an embodiment of the present application from a side view.
Figure 3:
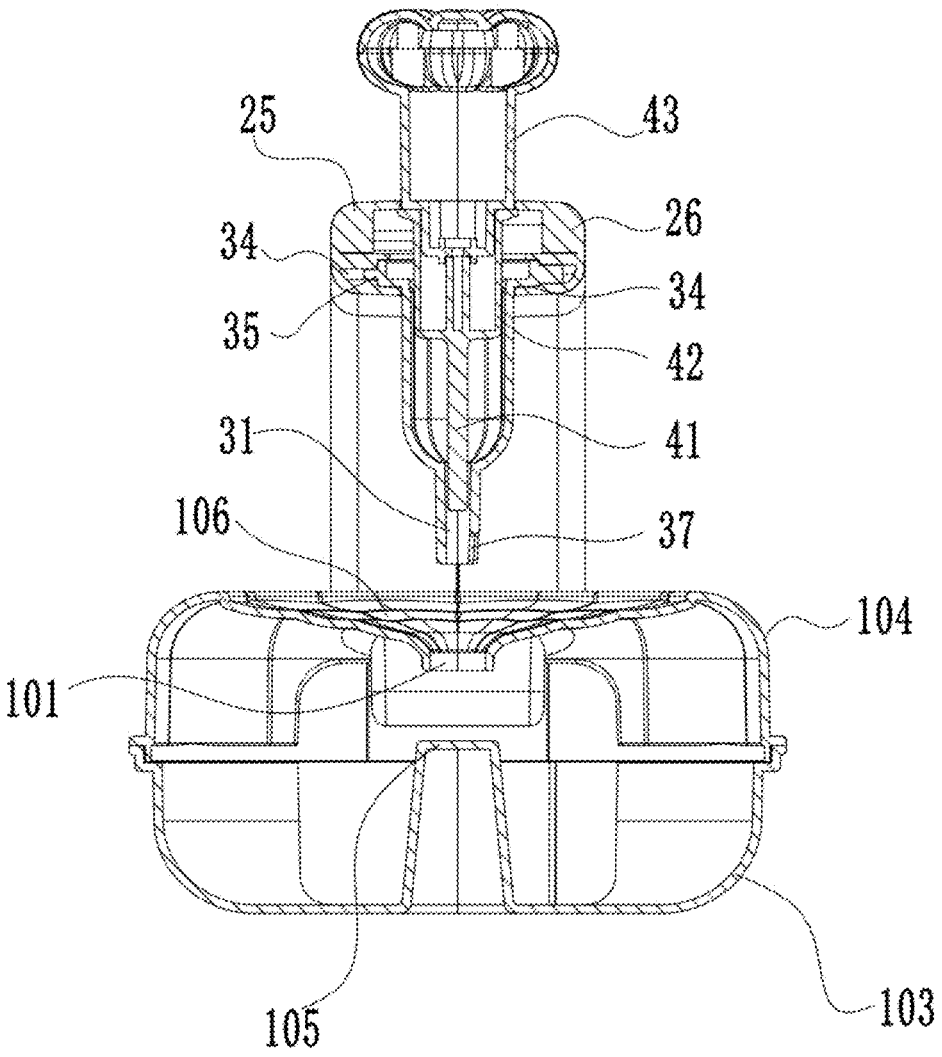
FIG. 3 is a cross-sectional schematic diagram of a structure according to an embodiment of the present application.

Specifically, as shown in FIGS. 1 to 3, the pressing machine includes a positioning housing 1 and a rotating arm 2 rotatably mounted on the positioning housing 1. The rotating arm 2 is equipped with a positioning sleeve 3 and a pressing member 4 slidably mounted in the positioning sleeve 3. The rotating arm 2 is adjusted by rotation relative to the positioning housing 1 to achieve position angle adjustment of the positioning sleeve 3 for preliminary positioning. The pressing member 4 can move up and down relative to the sliding sleeve 42 to further apply a pressing action, here the positioning sleeve 3 has a first guide hole 31 thereon, the pressing member 4 has a first pressing rod 41, and the first pressing rod 41 is slidably engaged relative to the first guide hole 31. Therefore, during the pressing process, the positioning sleeve 3 can press the petal portion and the leaf portion by adjusting an angle of the rotating arm 2, and at the same time position the stamen portion through the first guide hole 31. When the pressing member 4 pushes the first pressing rod 41 to further extend out of the first guide hole 31, the stamen is pressed into the inside of the petal. Therefore, the specific pressing action has two pressing processes, and finally completes the complete assembly of the entire craft flower.

During the pressing process, positioning is required. A positioning hole 101 for positioning the craft flower is provided on the positioning housing 1. The positioning hole 101 matches the positioning sleeve 3, in which the positioning hole 101 mainly positions the petal portion, the petal portion is initially plugged into the leaf portion, and the stamen portion is initially plugged into the petal. When adjusting the rotating arm 2 to rotate, the positioning sleeve 3 is driven to press on the petal portion and apply pressure so that the petal portion and the leaf portion are completely plugged in. While the leaf portion is pressed, the pressing member 4 applies pressure to drive the first pressing rod 41 to synchronously press the stamen portion into the leaf portion, and finally applies a pressing force to press the stamen portion, the petal portion and the leaf portion into place at the same time to complete the pressing.

Figure 4:
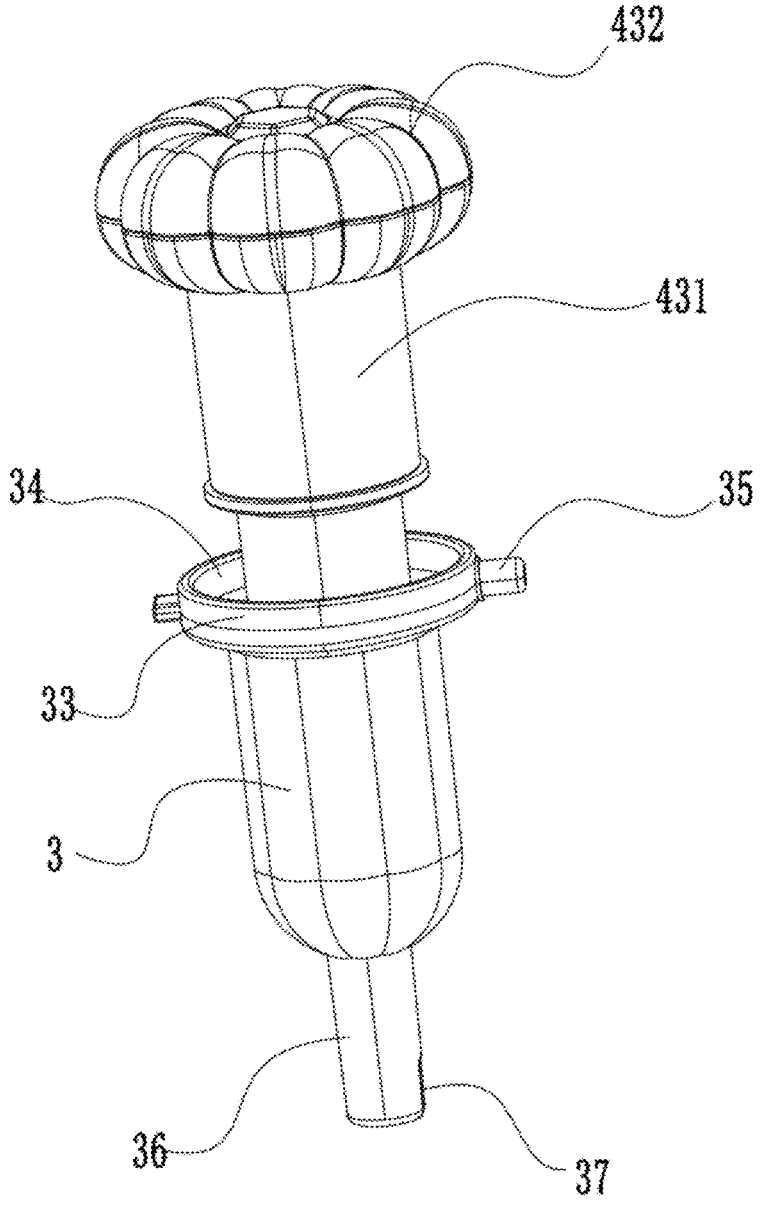
FIG. 4 is a schematic diagram of a structure of a pressing member engaging with a positioning sleeve according to an embodiment of the present application.
Figure 5:
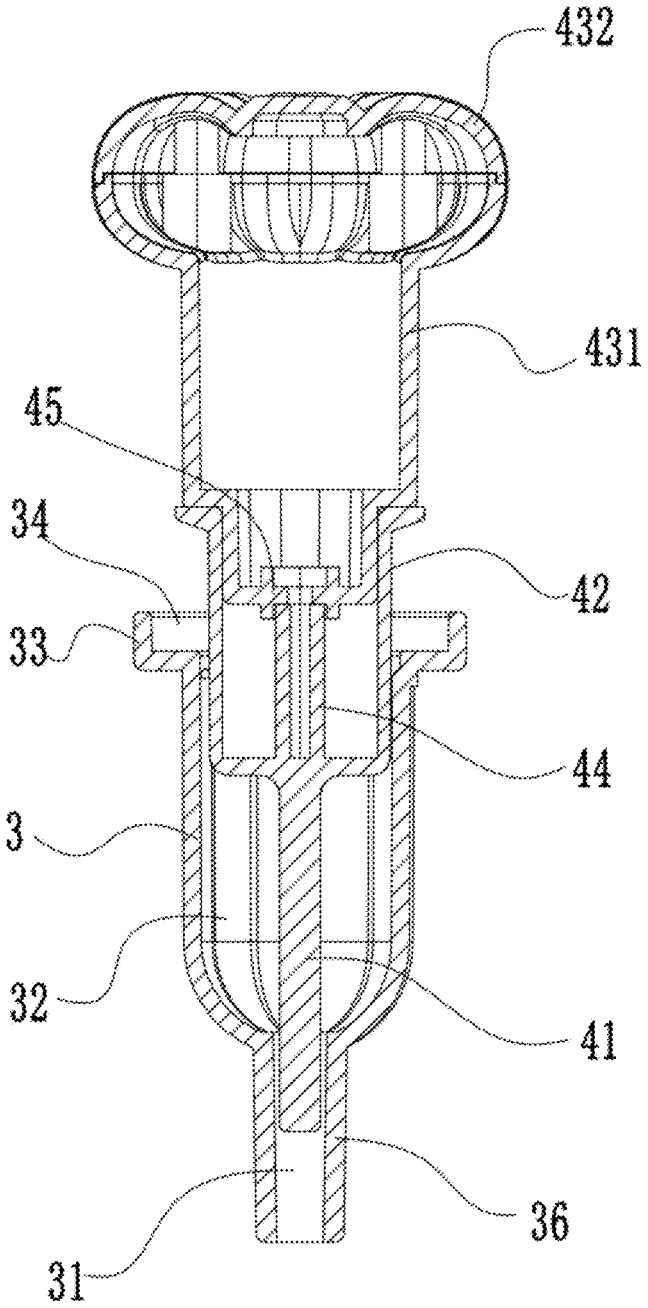
FIG. 5 is a cross-sectional schematic diagram of FIG. 4.

Here, the positioning sleeve 3 itself can apply a pressing force when the rotating arm 2 rotates, and at the same time slides and guides the pressing member 4. Specifically, as shown in FIGS. 4 and 5, the positioning sleeve 3 includes a second guide hole 32 connected to and coaxial with the first guide hole 31. The second guide hole 32 forms a slides and guides the pressing member 4, and when the pressing member 4 moves, it ensures that the first pressing rod 41 is stably guided and matched with the first guide hole 31. Moreover, the positioning sleeve 3 is provided with a first positioning portion 33 located at an opening of the second guide hole 32, and the first positioning portion 33 is provided with a first limiting groove 34, in which the first positioning portion 33 is configured to reliably limit the connection of the positioning sleeve 3 to the rotating arm 2, and the first limiting groove 34 is configured to limit the pressing member 4 when it moves down to a lowest position.

Here, an end portion of the positioning sleeve 3 is provided with a second positioning portion 36 extending downward, the first guide hole 31 passes through the second positioning portion 36, and a positioning notch 37 is provided at an opening of the second positioning portion 36. The positioning notch 37 can play a limiting role during the initial press-fitting of craft flowers, which is convenient for subsequent pressure application to ensure stable pressing.

The movement of the pressing member 4 relative to the positioning sleeve 3 further pushes the first pressing rod 41 to move, as shown in FIGS. 4 and 5, and the pressing member 4 includes a sliding sleeve 42 slidably mounted in the second guide hole 32, a pressing handle 43 is mounted on the sliding sleeve 42, a locking column 44 is arranged in the sliding sleeve 42, a locking portion 45 configured to fit with the locking column 44 is arranged in the pressing handle 43, and a fastener passes through the locking portion 45 and is fastened to the locking column 44. First, the sliding sleeve 42 can slide relative to the positioning sleeve 3 and will not be disengaged from the rotating arm 2. After the pressing handle 43 is connected to the sliding sleeve 42 through the fastener, the locking portion 45, and the locking column 44, it will not be disengaged from the sliding sleeve 42. Therefore, the entire pressing member 4 can move in the positioning sleeve 3 and will not be disengaged from the rotating arm 2.

Here, the pressing handle 43 includes a handle housing 431 mounted on the sliding sleeve 42 and a handle cover 432 detachably connected to the handle housing 431. The locking portion 45 is integrated at the bottom of the handle housing 431. The handle cover 432 can be removed relative to the handle housing 431, which facilitates the internal locking operation of the fastener and hides the fastener. The top of the handle housing 431 is enclosed with the handle housing 431 to form a flower-shaped structure, which can facilitate the application of pressing force on the one hand and enhance the aesthetics on the other hand.

Specifically, the rotating arm 2 is provided with a mounting groove 22 for mounting the first positioning portion 33, at least two limiting protrusions 35 extending outward are provided on an outer side of the first positioning portion 33, and the mounting groove 22 is provided with a rotation stop groove 23 plug-fitted to the limiting protrusion 35. After the first positioning portion 33 is mounted through the mounting groove 22, the positioning sleeve 3 can be prevented from rotating relative to the rotating arm 2 under the engagement of the limiting protrusion 35 and the rotation stop groove 23, ensuring that the positioning sleeve 3 is in a fixed state, which can ensure its positioning effect during initial pressing.

Moreover, the rotating arm 2 is provided with a sliding hole 24 that is slidably engaged with the handle housing 431, and a diameter of the opening end portion of the sliding sleeve 42 is larger than an aperture of the sliding hole 24. The sliding hole 24 allows the pressing member 4 to slide relative to the positioning sleeve 3, and when the sliding sleeve 42 moves upward, it is limited by the sliding hole 24, so that the entire pressing member 4 can be reliably mounted between the rotating arm 2 and the positioning sleeve 3, and the sliding stroke limit from the lowest point to the highest point of the pressing member 4 is achieved through the first limiting groove 34 and the sliding hole 24.

Here, the rotating arm 2 can achieve a certain range of angle adjustment by rotation relative to the positioning housing 1, such as rotating and removing the rotating arm 2 during the placement of craft flower parts, and then rotating the rotating arm 2 for reset when specifically pressed. Specifically, a rotating end of the rotating arm 2 is provided with a rotating portion 21 extending to both sides, a rotating groove 102 is opened on the positioning housing 1, and the rotating portion 21 is rotatably connected to two side walls of the rotating groove 102. The entire rotating arm 2 is rotationally connected through the rotating portion 21. The rotating groove 102 is configured to form a stroke limit on a rotation angle of the rotating arm 2.

Figure 9:
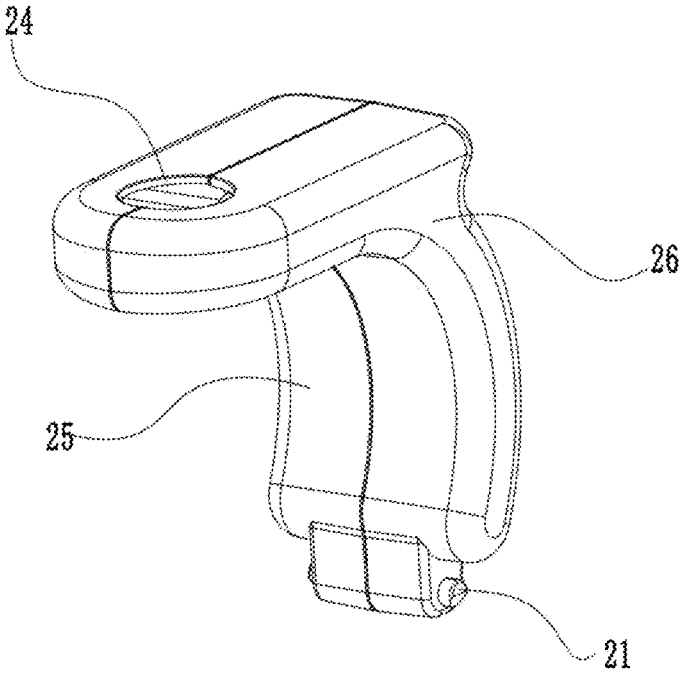
FIG. 9 is a schematic diagram of a structure of a rotating arm according to an embodiment of the present application.
Figure 10:
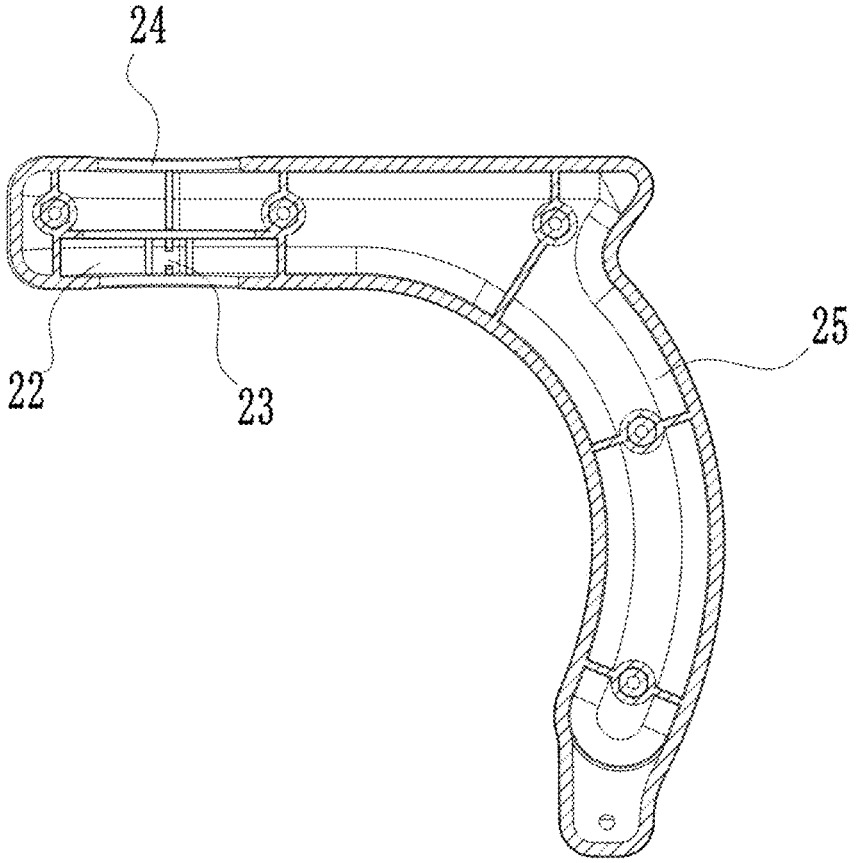
FIG. 10 is a cross-sectional schematic diagram of FIG. 9.

In order to facilitate the assembly of the positioning sleeve 3 and the pressing member 4 in the rotating arm 2, as shown in FIGS. 9 and 10, the rotating arm 2 includes a first arm housing 25 and a second arm housing 26 that are detachably connected, and a plurality of plugging posts and plugging sleeves are arranged along the first arm housing 25 and the second arm housing 26. The first arm housing 25 and the second arm housing 26 are assembled by interference fit between the plugging posts and the plugging sleeves, and the strength of the first arm housing 25 and the second arm housing 26 is enhanced respectively by arranging reinforcing ribs on the plugging posts and the plugging sleeves.

The positioning housing 1 serves as a bearing base of the entire pressing machine, and the interior of the positioning housing 1 can be used as a parts storage space for the craft flower. Therefore, considering that the positioning housing 1 is an openable structure, specifically, the positioning housing 1 includes a bottom housing 103 and a top housing 104 that are screw-fitted, the positioning hole 101 is arranged in the middle of the top housing 104, and a positioning platform 105 protruding upward is arranged in the bottom housing 103, and the positioning platform 105 is coaxial with the positioning hole 101. The rotating groove 102 is provided on the top housing 104, so that the bottom housing 103 can be rotated to open or close relative to the top housing 104, which is convenient for storing items in the internal space, and the positioning platform 105 can form a sleeve placement for the internal items, and can also play a supporting role at the lowest point when pressed.

Figure 6:
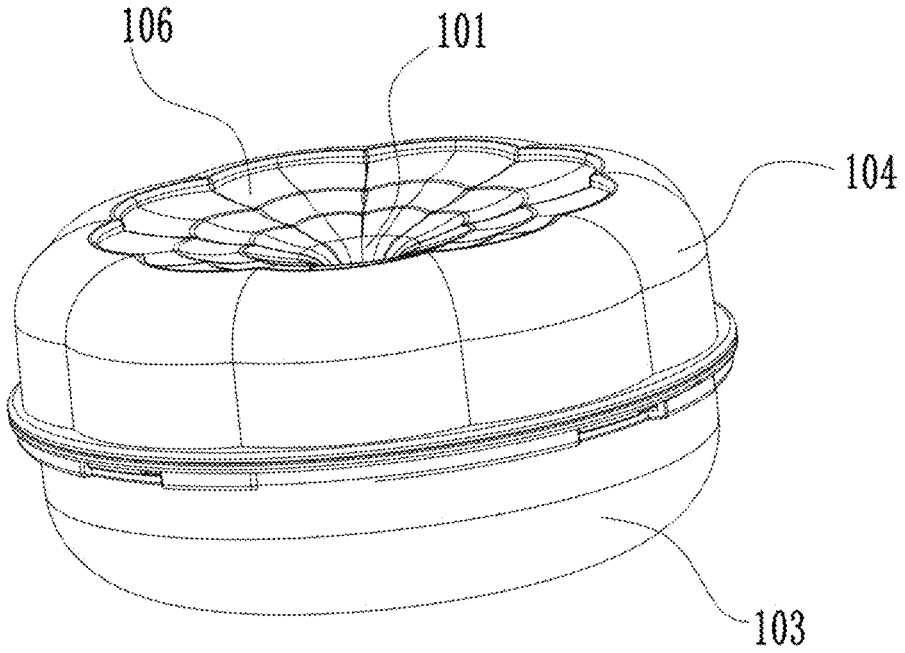
FIG. 6 is a schematic diagram of a structure of a positioning housing according to an embodiment of the present application.
Figure 7:
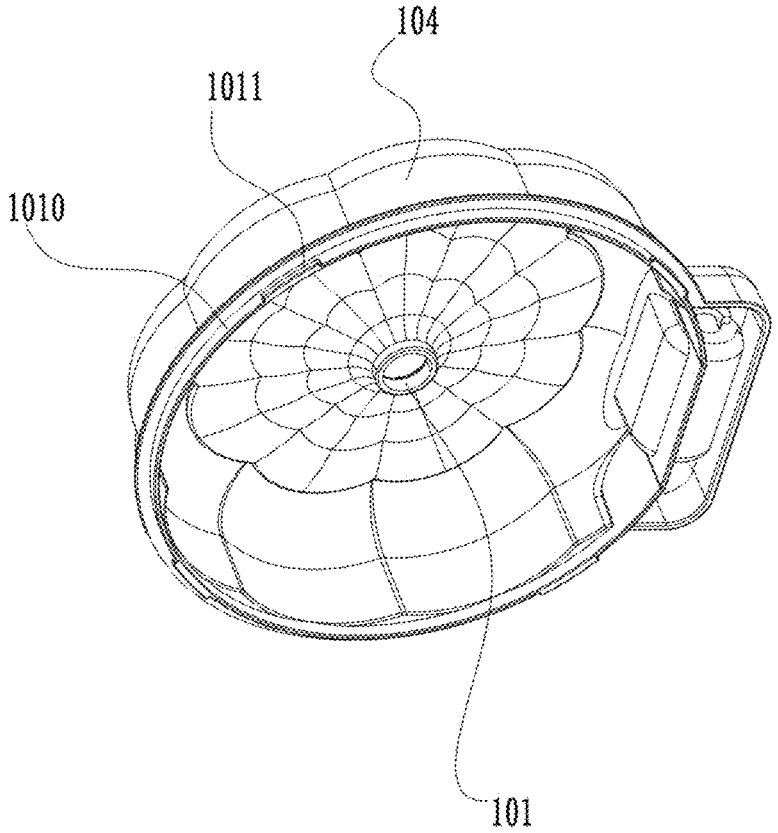
FIG. 7 is a schematic diagram of a structure of a top housing according to an embodiment of the present application.
Figure 8:
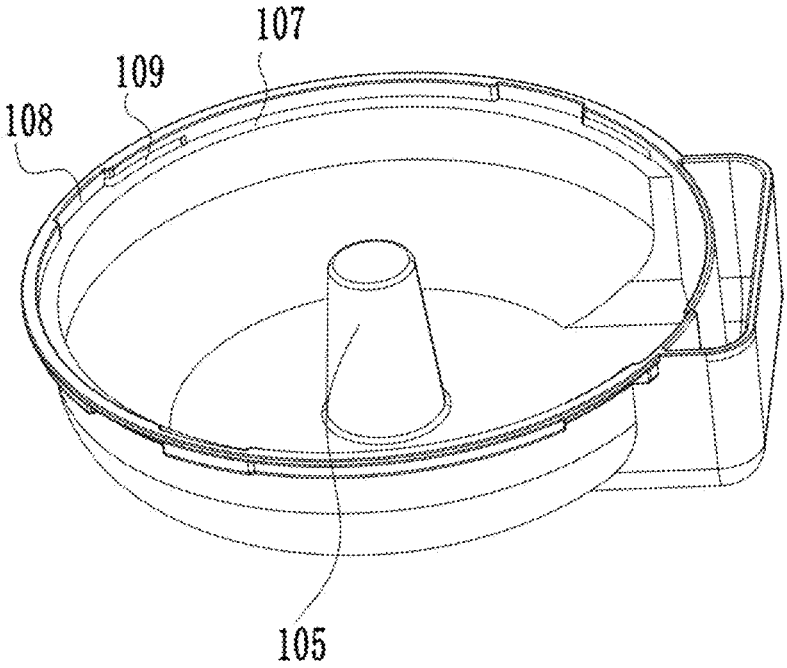
FIG. 8 is a schematic diagram of a structure of a bottom housing according to an embodiment of the present application.

Here, as shown in FIGS. 6 to 8, a positioning step 107 is provided at an opening of the bottom housing 103, multiple grooves 108 and multiple limiting bayonets 109 evenly distributed along a circumference are provided on a side wall of the positioning step 107, and the groove 108 and the limiting bayonet 109 are one-to-one connected correspondingly. An opening of the top housing 104 is provided with a limiting edge 1010 extending into the positioning step 107, and a side wall of the limiting edge 1010 is provided with snap-fit bosses 1011 evenly distributed along a circumference and correspondingly engaged with the limiting bayonet 109; when the top housing 104 is rotated and locked relative to the bottom housing 103, the snap-fit boss 1011 rotates from the groove 108 to the limiting bayonet 109; in this way, it is possible to achieve locking or loosening between the bottom housing 103 and the top housing 104 by adjusting the rotation direction.

The top housing 104 is provided with a conical surface 106 inclined toward the positioning hole 101, and the conical surface 106 is provided with a flower-patterned surface, in which the conical surface 106 facilitates viewing of the assembly state of the pressed craft flower during the pressing operation, and enables the craft flower to be well positioned at the positioning hole 101 during preliminary positioning, and the flower-patterned surface formed on the top housing 104 can have an anti-skid effect and improve the appearance.

Moreover, a cross-section of the entire positioning housing 1 is a flower-shaped structure, which can increase the size of the placement positioning surface and make the whole more stable. In addition, the overall appearance is flower-shaped, which can enhance the sense of aesthetics.

In the present application, unless otherwise specified or restricted, the terms of "installation", "interconnection", "connection" and "fixing" shall be understood as a general sense. For example, the connection can be fixed connection, removable connection, integrated connection, mechanical connection, electrical connection, direct connection, indirect connection through intermediate media, connection between two components or interaction between two components. Persons of ordinary skill in the art can understand the specific meanings of the above terms in the present application as appropriate.

In the description of the present application, it needs to be noted that the azimuth or position relationships indicated by the terms "center", "upper", "lower", "left", "right", "inside" and "outside" are based on those shown in the drawings, or those in which a product of the present application is usually placed when used. It is only for convenience of description and simplification of the present application, not to indicate or imply that the referred devices or components must have a specific orientation, be constructed and operate in a specific orientation, and thus cannot be understood as limiting the present application. Furthermore, the terms "first" and "second" are used merely for distinguishing purposes and shall not be construed as indicating or implying relative importance.

It is obvious to those skilled in the art that the present application is not limited to the details of the above exemplary embodiment, and can be implemented in other specific forms without departing from the spirit or basic features of the present application. Therefore, no matter from which point of view, the embodiment should be regarded as exemplary and non-limiting. The scope of the present application is defined by the claims rather than the above description, so it is intended to include all changes that fall within the meaning and scope of the equivalent elements of the claims in the present application. Any reference numerals in the claims should not be regarded as limiting the claims involved.

What is claimed is:

1. A pressing machine for assembling craft flowers, comprising a positioning housing and a rotating arm rotatably mounted on the positioning housing;

the rotating arm is equipped with a positioning sleeve and a pressing member slidably mounted in the positioning sleeve, the positioning sleeve has a first guide hole, the pressing member has a first pressing rod, and the first pressing rod slides relative to the first guide hole; and the positioning housing is provided with a positioning hole for positioning the craft flower, and the positioning hole matches the positioning sleeve;

wherein the positioning sleeve comprises a second guide hole connected to and coaxial with the first guide hole, the positioning sleeve is provided with a first positioning portion located at an opening of the second guide hole, and the first positioning portion is provided with a first limiting groove; and wherein the pressing member comprises a sliding sleeve slidably mounted in the second guide hole, a pressing handle is mounted on the sliding sleeve, a locking column is arranged in the sliding sleeve, a locking portion configured to fit with the locking column is arranged in the pressing handle, and a fastener passes through the locking portion and is fastened to the locking column;

wherein the pressing handle comprises a handle housing mounted on the sliding sleeve and a handle cover detachably connected to the handle housing, and the locking portion is integrated at the bottom of the handle housing; and wherein a rotating end of the rotating arm is provided with a rotating portion extending to both sides, a rotating groove is opened on the positioning housing, and two ends of the rotating portion are rotatably connected to two side walls of the rotating groove, respectively.

2. A pressing machine for assembling craft flowers according to claim 1, wherein the top of the handle housing and the handle housing are enclosed to form a flower-shaped structure.

3. A pressing machine for assembling craft flowers according to claim 1, wherein the rotating arm is provided with a mounting groove for mounting the first positioning portion, at least two limiting protrusions extending outward are provided on an outer side of the first positioning portion, and the mounting groove is provided with a rotation stop groove plug-fitted to the limiting protrusion; and the rotating arm is provided with a sliding hole that is slidably engaged with the handle housing, and a diameter of the opening end portion of the sliding sleeve is larger than an aperture of the sliding hole.

4. A pressing machine for assembling craft flowers according to claim 3, wherein the rotating arm comprises a first arm housing and a second arm housing that are detachably connected.

5. A pressing machine for assembling craft flowers according to claim 1, wherein the positioning housing comprises a bottom housing and a top housing that are screw-fitted, the positioning hole is arranged in the middle of the top housing, an upwardly protruding positioning platform is arranged in the bottom housing, and the positioning platform is coaxial with the positioning hole; and the rotating groove is arranged on the top housing.

6. A pressing machine for assembling craft flowers according to claim 5, wherein the top housing is provided with a conical surface inclined toward the positioning hole, and the conical surface is provided with a flower-patterned surface.

7. A pressing machine for assembling craft flowers according to claim 6, wherein a cross section of the positioning housing is a flower-shaped structure.

8. A pressing machine for assembling craft flowers according to claim 7, wherein a positioning step is provided at an opening of the bottom housing, multiple grooves and multiple limiting bayonets evenly distributed along a circumference are provided on a side wall of the positioning step, and the groove and the limiting bayonet are one-to-one connected correspondingly;

an opening of the top housing is provided with a limiting edge extending into the positioning step, and a side wall of the limiting edge is provided with snap-fit bosses evenly distributed along a circumference and engaged with the limiting bayonet; and when the top housing is rotated and locked relative to the bottom housing, the snap-fit boss rotates from the groove to the limiting bayonet.

9. A pressing machine for assembling craft flowers according to claim 1, wherein an end portion of the positioning sleeve is provided with a second positioning portion extending downward, the first guide hole passes through the second positioning portion, and a positioning notch is provided at an opening of the second positioning portion.

* * * * *